US007571943B1

(12) United States Patent
Lee

(10) Patent No.: US 7,571,943 B1
(45) Date of Patent: Aug. 11, 2009

(54) RETRACTABLE CHOPSTICK

(75) Inventor: Lung-Chou Lee, Changhua (TW)

(73) Assignee: Hsin Lung Enterprise Co., Ltd., Changhua (TW)

( * ) Notice: Subject to any disclaimer, the term of this patent is extended or adjusted under 35 U.S.C. 154(b) by 183 days.

(21) Appl. No.: 11/732,749

(22) Filed: Apr. 4, 2007

(51) Int. Cl.
*A47G 21/10* (2006.01)

(52) U.S. Cl. ..... 294/1.1; 294/5.5

(58) Field of Classification Search ..... 294/1.1, 294/5.5, 99.2; 30/322–324, 326, 340; 403/378
See application file for complete search history.

(56) References Cited

U.S. PATENT DOCUMENTS 7,093,868 B1 * 8/2006 Shen ..... 294/1.1
7,258,375 B1 * 8/2007 Shen ..... 294/1.1
7,341,293 B2 * 3/2008 Tsai ..... 294/1.1
2007/0080552 A1 * 4/2007 Lai ..... 294/99.2
2008/0079274 A1 * 4/2008 Shen Ku ..... 294/1.1

FOREIGN PATENT DOCUMENTS

JP 411009417 A * 1/1999

* cited by examiner

*Primary Examiner*—Dean J Kramer
(74) *Attorney, Agent, or Firm*—Alan Kamrath; Kamrath & Associates PA

(57) ABSTRACT

A retractable chopstick includes a hollow mounting sleeve, and a shank retractably mounted in the mounting sleeve and movable relative to the mounting sleeve between a retracted position where an upper end of the shank is locked in an upper end of the mounting sleeve and a lower end of the shank is received in a lower end of the mounting sleeve and an expanded position where the shank protrudes outwardly from the mounting sleeve and the upper end of the shank is locked in the lower end of the mounting sleeve. Thus, the shank can be retracted into the mounting sleeve when not in use, so that whole volume of the retractable chopstick is reduced largely, thereby facilitating the user carrying, packaging and storing the retractable chopstick.

19 Claims, 10 Drawing Sheets

RETRACTABLE CHOPSTICK

BACKGROUND OF THE INVENTION

1. Field of the Invention

The present invention relates to a chopstick and, more particularly, to a retractable chopstick.

2. Description of the Related Art

A pair of chopsticks are usually available for the oriental people and can be used to hold food to facilitate the user eating the food. However, the chopsticks have a determined length, thereby causing inconvenience to the user in storage, packaging and carrying of the chopsticks.

BRIEF SUMMARY OF THE INVENTION

In accordance with the present invention, there is provided a retractable chopstick, comprising a hollow mounting sleeve, and a shank retractably mounted in the mounting sleeve and movable relative to the mounting sleeve between a retracted position where an upper end of the shank is locked in an upper end of the mounting sleeve and a lower end of the shank is received in a lower end of the mounting sleeve and an expanded position where the shank protrudes outwardly from the mounting sleeve and the upper end of the shank is locked in the lower end of the mounting sleeve.

The primary objective of the present invention is to provide a retractable chopstick, wherein the shank can be retracted into the mounting sleeve when not in use, so that whole volume of the retractable chopstick is reduced largely, thereby facilitating the user carrying, packaging and storing the retractable chopstick.

Another objective of the present invention is to provide a retractable chopstick, wherein the retractable chopstick can be reused successively, thereby saving the natural resource and thereby providing a sanitary effect.

A further objective of the present invention is to provide a retractable chopstick, wherein the user only needs to rotate the shank relative to the mounting sleeve to expand the shank outwardly from the mounting sleeve or to retract the shank into the mounting sleeve, thereby facilitating the user operating the retractable chopstick.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
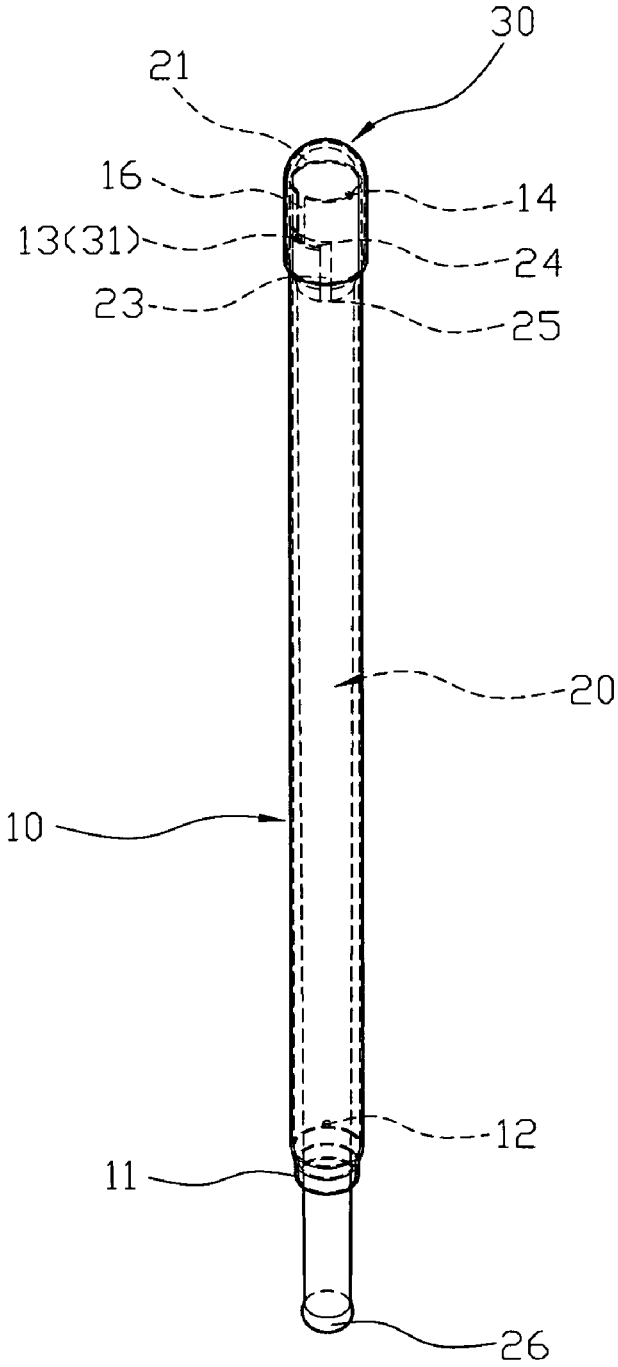
FIG. 1 is a perspective view of a retractable chopstick in accordance with the preferred embodiment of the present invention.
Figure 2:
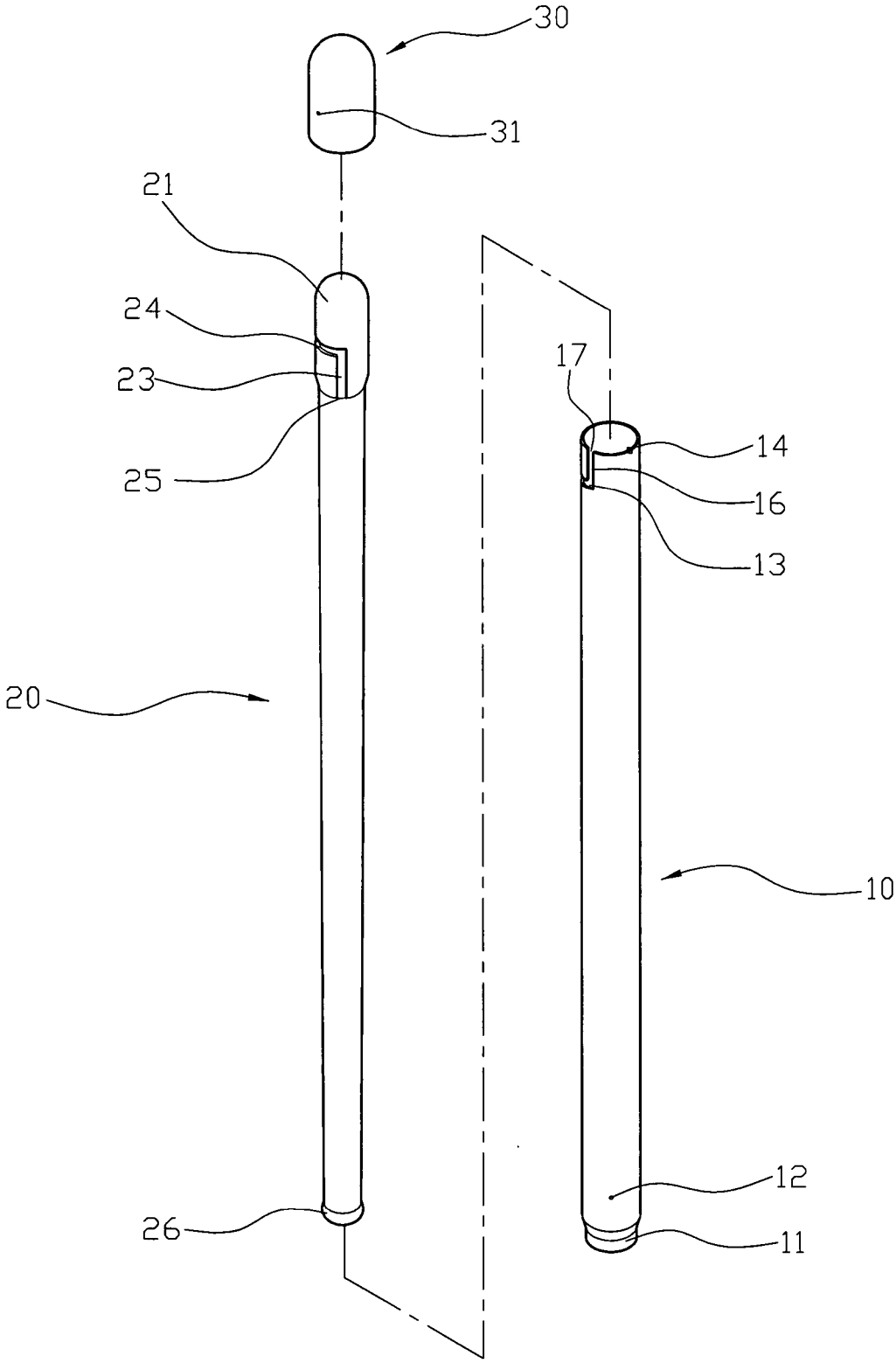
FIG. 2 is an exploded perspective view of the retractable chopstick as shown in FIG. 1.
Figure 3:
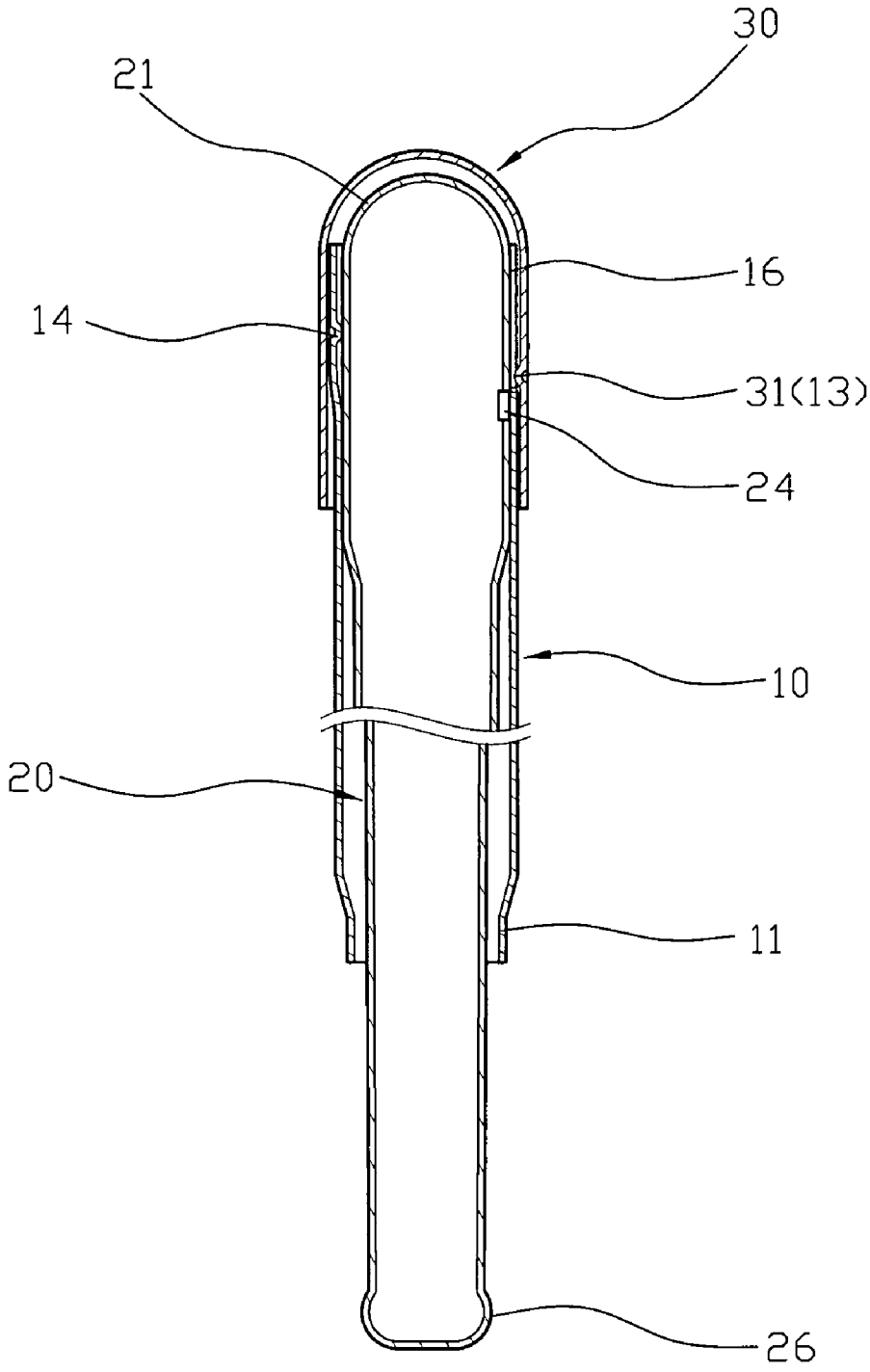
FIG. 3 is a front cross-sectional view of the retractable chopstick as shown in FIG. 1.

Referring to the drawings and initially to FIGS. 1-3, a retractable chopstick in accordance with the preferred embodiment of the present invention comprises a hollow mounting sleeve 10, a shank 20 retractably mounted in the mounting sleeve 10 and movable relative to the mounting sleeve 10 between a retracted position where an upper end of the shank 20 is locked in an upper end of the mounting sleeve 10 and a lower end of the shank 20 is received in a lower end of the mounting sleeve 10 and an expanded position where the shank 20 protrudes outwardly from the mounting sleeve 10 and the upper end of the shank 20 is locked in the lower end of the mounting sleeve 10, and a top cap 30 mounted on the upper end of the mounting sleeve 10 to prevent the upper end of the shank 20 from being detachable from the upper end of the mounting sleeve 10 when the shank 20 is disposed at the retracted position.

The shank 20 is detachably inserted into the mounting sleeve 10 from the upper end of the mounting sleeve 10. The upper end of the shank 20 is provided with an enlarged head 21 having a diameter smaller than that of the mounting sleeve 10. The head 21 of the shank 20 has a periphery formed with an axially extending guide groove 23 and a transversely extending locking groove 24 connected to the guide groove 23. The guide groove 23 of the head 21 has an upper end connected to the locking groove 24 and a lower end formed with an opening 25 located at a connection of the head 21 and the upper end of the shank 20. The locking groove 24 of the head 21 is perpendicular to the guide groove 23 so that the guide groove 23 and the locking groove 24 of the head 21 form a substantially inverted L-shaped profile. The lower end of the shank 20 is provided with a radially and outwardly extending annular holding portion 26 which protrudes outwardly from the lower end of the mounting sleeve 10.

The lower end of the mounting sleeve 10 is formed with a radially and inwardly extending lower positioning boss 12 that is inserted through the opening 25 into the guide groove 23 of the head 21 and detachably locked in the locking groove 24 of the head 21 when the shank 20 is disposed at the expanded position so that the head 21 of the shank 20 is locked in the lower end of the mounting sleeve 10. The lower end of the mounting sleeve 10 has an end portion formed with a tapered and stepped enclosure 11 located under the lower positioning boss 12 and having a diameter smaller than that of the head 21 of the shank 20.

The upper end of the mounting sleeve 10 is formed with a radially and inwardly extending upper positioning boss 14 that presses the periphery of the head 21 when the shank 20 is disposed at the retracted position so that the head 21 of the shank 20 is locked in the upper end of the mounting sleeve 10. The upper end of the mounting sleeve 10 has a periphery formed with an axially extending guide groove 16 and a transversely extending locking groove 13 connected to the guide groove 16. The guide groove 16 of the mounting sleeve 10 has a lower end connected to the locking groove 13 and an upper end formed with an opening 17. The locking groove 13 of the mounting sleeve 10 is perpendicular to the guide groove 16 so that the guide groove 16 and the locking groove 13 of the mounting sleeve 10 form a substantially inverted L-shaped profile.

The top cap 30 is removably mounted on the upper end of the mounting sleeve 10 to stop the head 21 of the shank 20. The top cap 30 is formed with a radially and inwardly extending lower locking boss 31 that is inserted through the opening 17 into the guide groove 16 of the mounting sleeve 10 and detachably locked in the locking groove 13 of the mounting sleeve 10 so that the top cap 30 is locked on the upper end of the mounting sleeve 10.

In assembly, the shank 20 is inserted into the mounting sleeve 10 from the upper end of the mounting sleeve 10. At this time, the upper positioning boss 14 of the mounting sleeve 10 presses the periphery of the head 21 when the shank 20 is disposed at the retracted position so that the head 21 of the shank 20 is locked in the upper end of the mounting sleeve 10. Then, when the top cap 30 is mounted on the upper end of the mounting sleeve 10, the locking boss 31 of the top cap 30 is inserted through the opening 17 into the guide groove 16 of the mounting sleeve 10 and detachably locked in the locking groove 13 of the mounting sleeve 10 by rotation of the top cap 30 relative to the mounting sleeve 10 so that the top cap 30 is locked on the upper end of the mounting sleeve 10.

Figure 4:
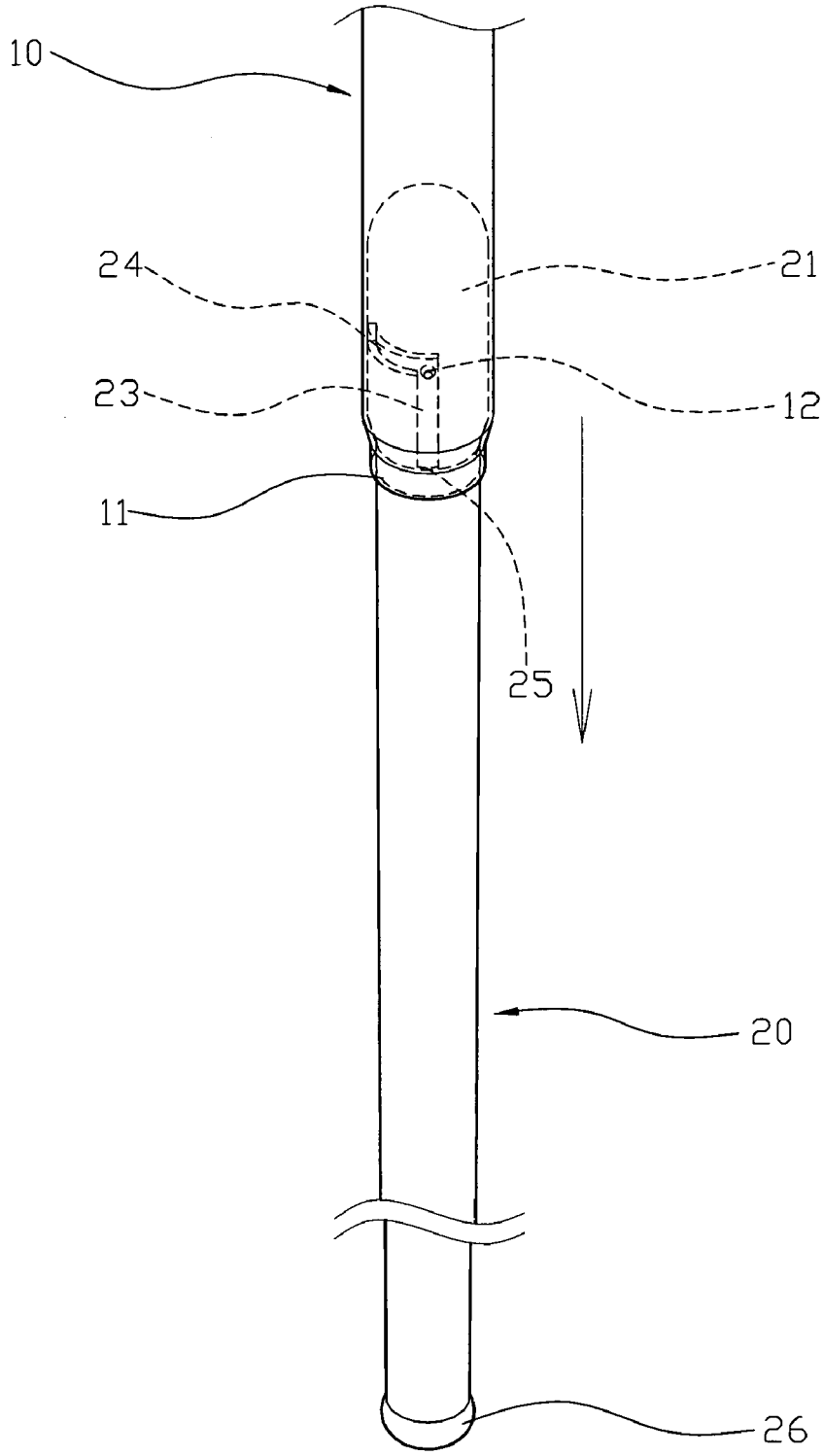
FIG. 4 is a schematic operational view of the retractable chopstick as shown in FIG. 1.
Figure 5:
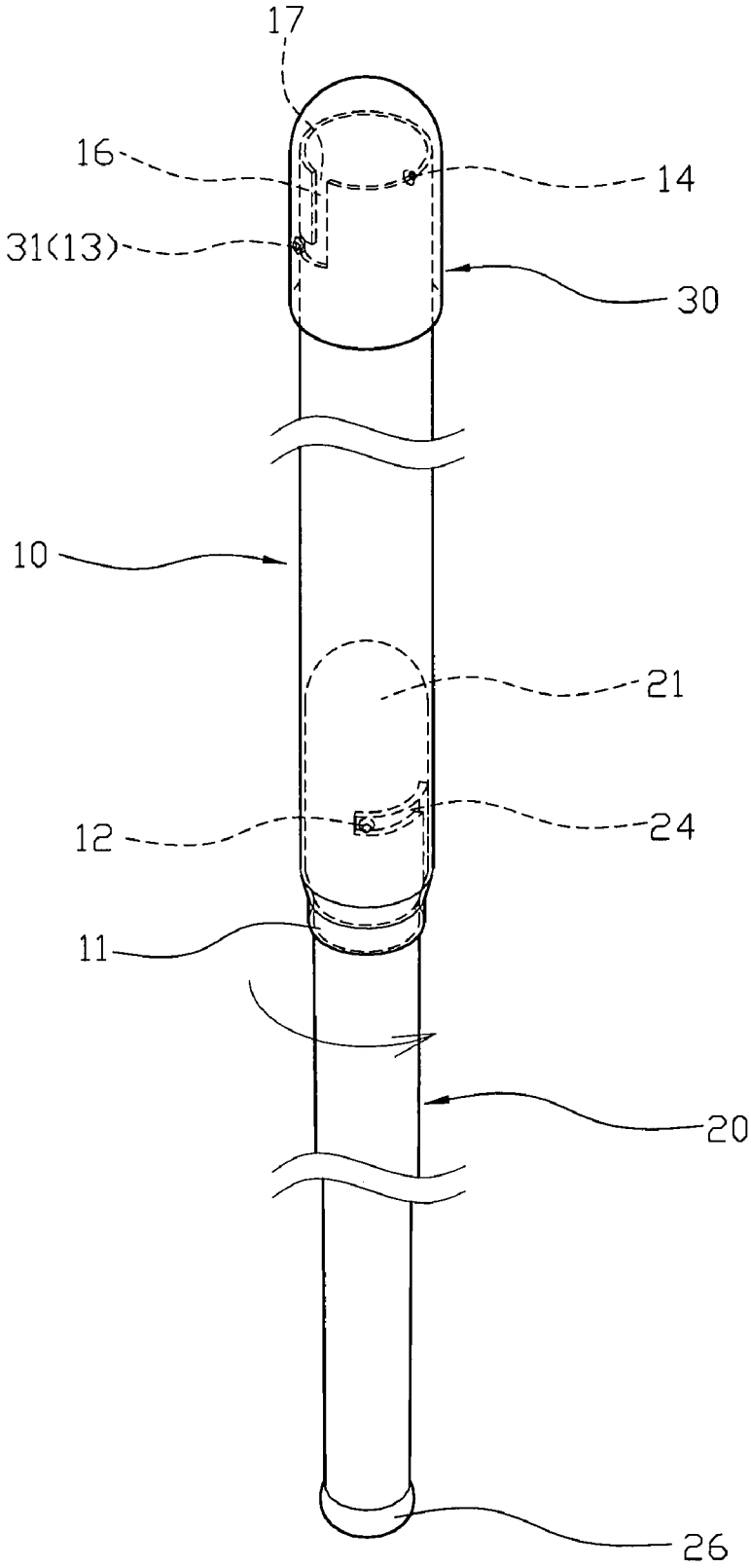
FIG. 5 is a schematic operational view of the retractable chopstick as shown in FIG. 4.

In operation, referring to FIGS. 4 and 5 with reference to FIGS. 1-3, when the shank 20 is pulled outwardly relative to the mounting sleeve 10, the head 21 of the shank 20 is released from the upper positioning boss 14 of the mounting sleeve 10 and movable downward in the mounting sleeve 10. When the shank 20 is disposed at the expanded position, the lower positioning boss 12 of the mounting sleeve 10 is inserted through the opening 25 into the guide groove 23 of the head 21 as shown in FIG. 4 and detachably locked in the locking groove 24 of the head 21 as shown in FIG. 5 by rotation of the shank 20 relative to the mounting sleeve 10 so that the head 21 of the shank 20 is locked in the lower end of the mounting sleeve 10. Thus, when the shank 20 is disposed at the expanded position as shown in FIG. 5, the lower positioning boss 12 of the mounting sleeve 10 is locked in the locking groove 24 of the head 21 so that the shank 20 is locked on the mounting sleeve 10 to facilitate a user operating the shank 20. At this time, the head 21 of the shank 20 is retained by the enclosure 11 of the mounting sleeve 10 when the shank 20 is disposed at the expanded position to prevent the shank 20 from incurring vibration.

On the contrary, the shank 20 is rotated relative to the mounting sleeve 10 in the opposite direction so that the shank 20 is unlocked from the mounting sleeve 10 and can be retracted into the mounting sleeve 10 as shown in FIGS. 1 and 3. At this time, the upper positioning boss 14 of the mounting sleeve 10 presses the periphery of the head 21 when the shank 20 is disposed at the retracted position so that the head 21 of the shank 20 is locked in the upper end of the mounting sleeve 10.

Figure 6:
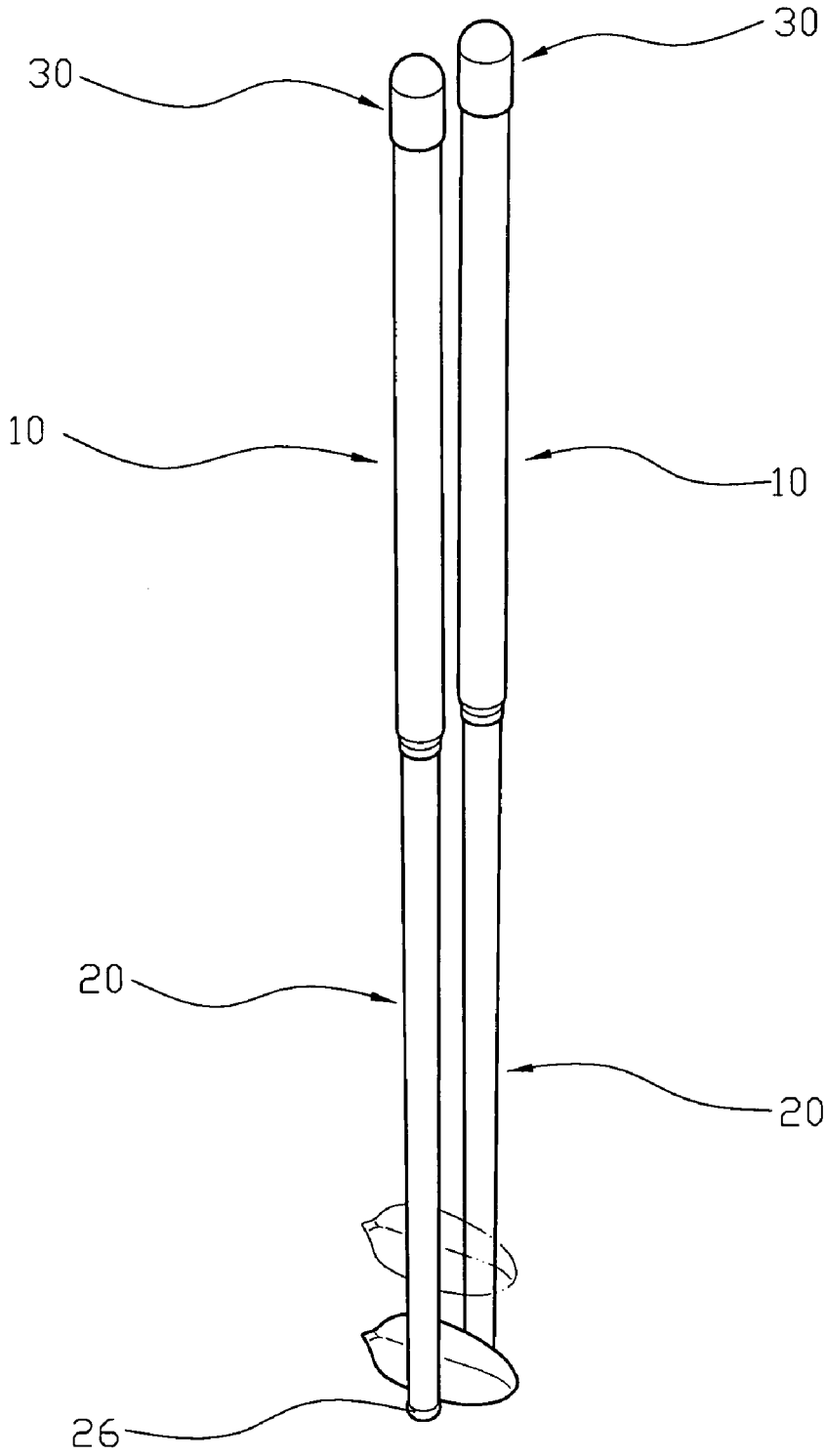
FIG. 6 is a schematic operational view of the retractable chopstick as shown in FIG. 1.

As shown in FIG. 6, the holding portion 26 of the shank 20 is used to stop and hold a food to facilitate the user operating the shank 20 to hold the food.

Figure 7:
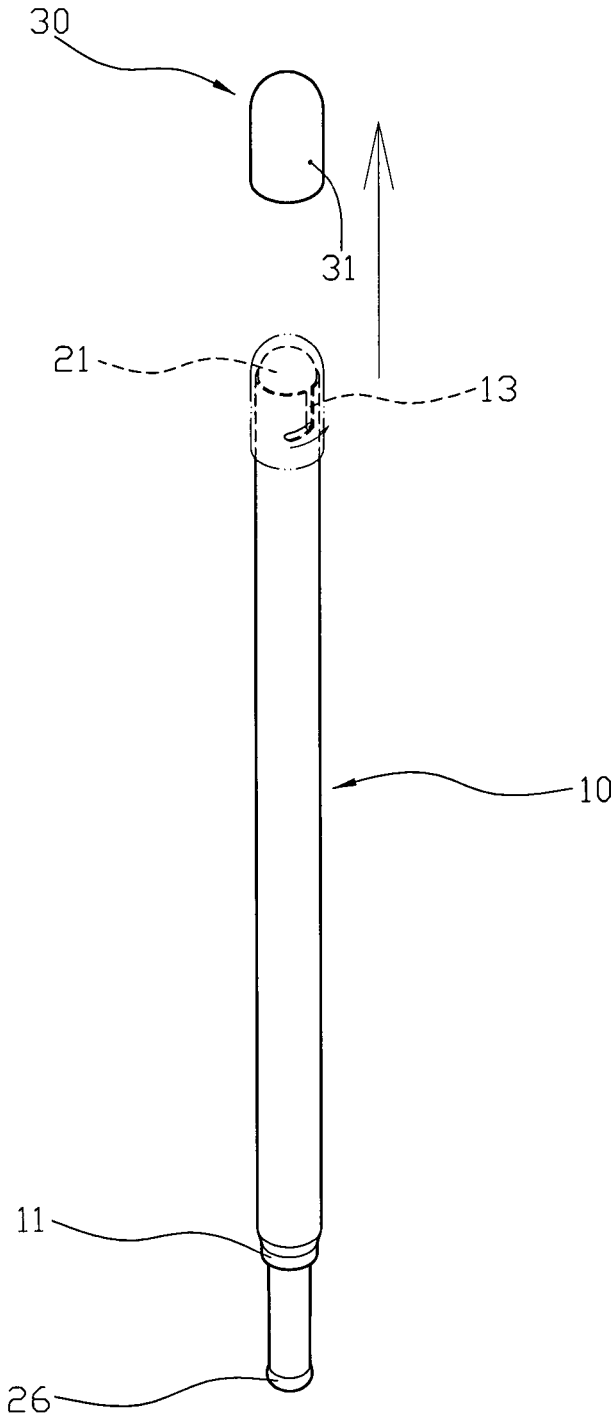
FIG. 7 is a schematic operational view of the retractable chopstick as shown in FIG. 1.

As shown in FIG. 7, the top cap 30 is rotated relative to the mounting sleeve 10 in the opposite direction so that the top cap 30 is unlocked from the mounting sleeve 10 and can be removed from the mounting sleeve 10.

Figure 8:
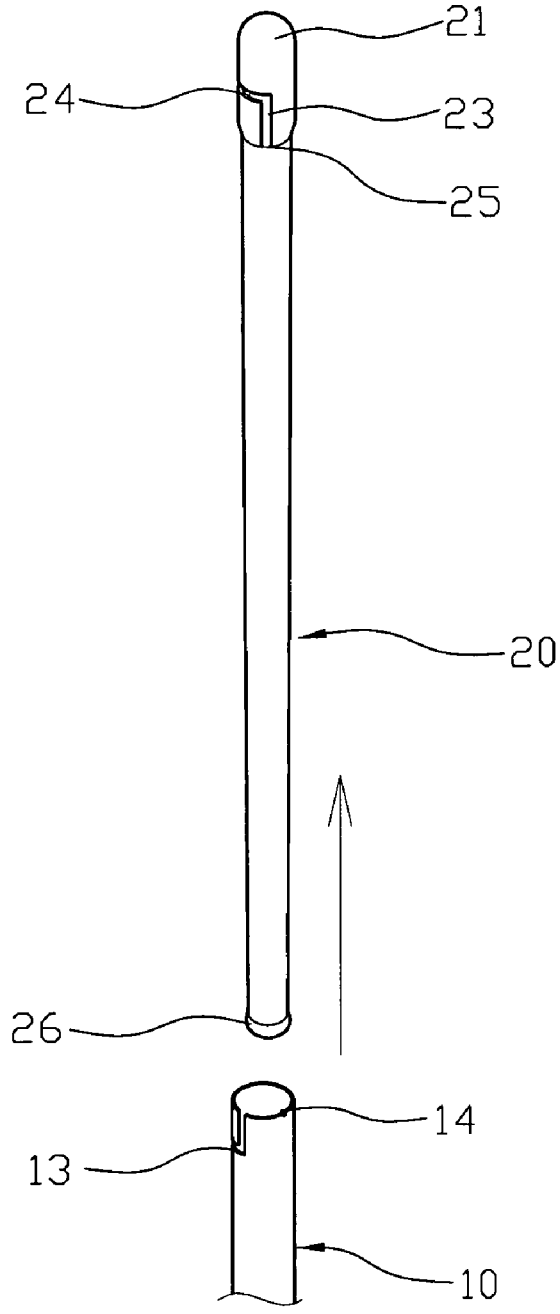
FIG. 8 is a schematic operational view of the retractable chopstick as shown in FIG. 7.

As shown in FIG. 8, the shank 20 is detached from the mounting sleeve 10 after the top cap 30 is removed from the mounting sleeve 10 so that the shank 20 and the mounting sleeve 10 can be washed individually.

Figure 9:
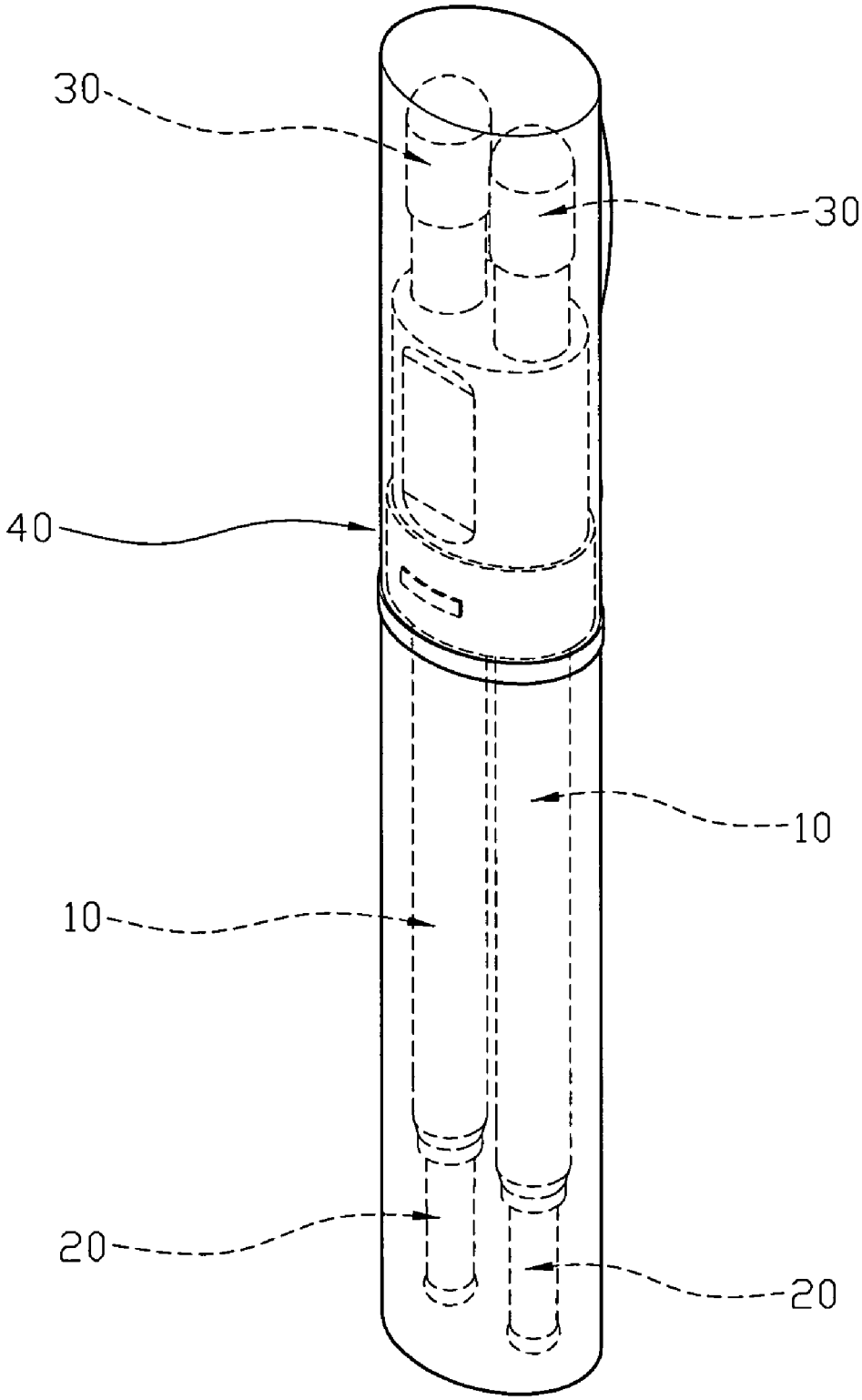
FIG. 9 is a perspective view showing the retractable chopstick being placed in a storage box.

As shown in FIG. 9, the retractable chopstick is received in a storage box 40.

Figure 10:
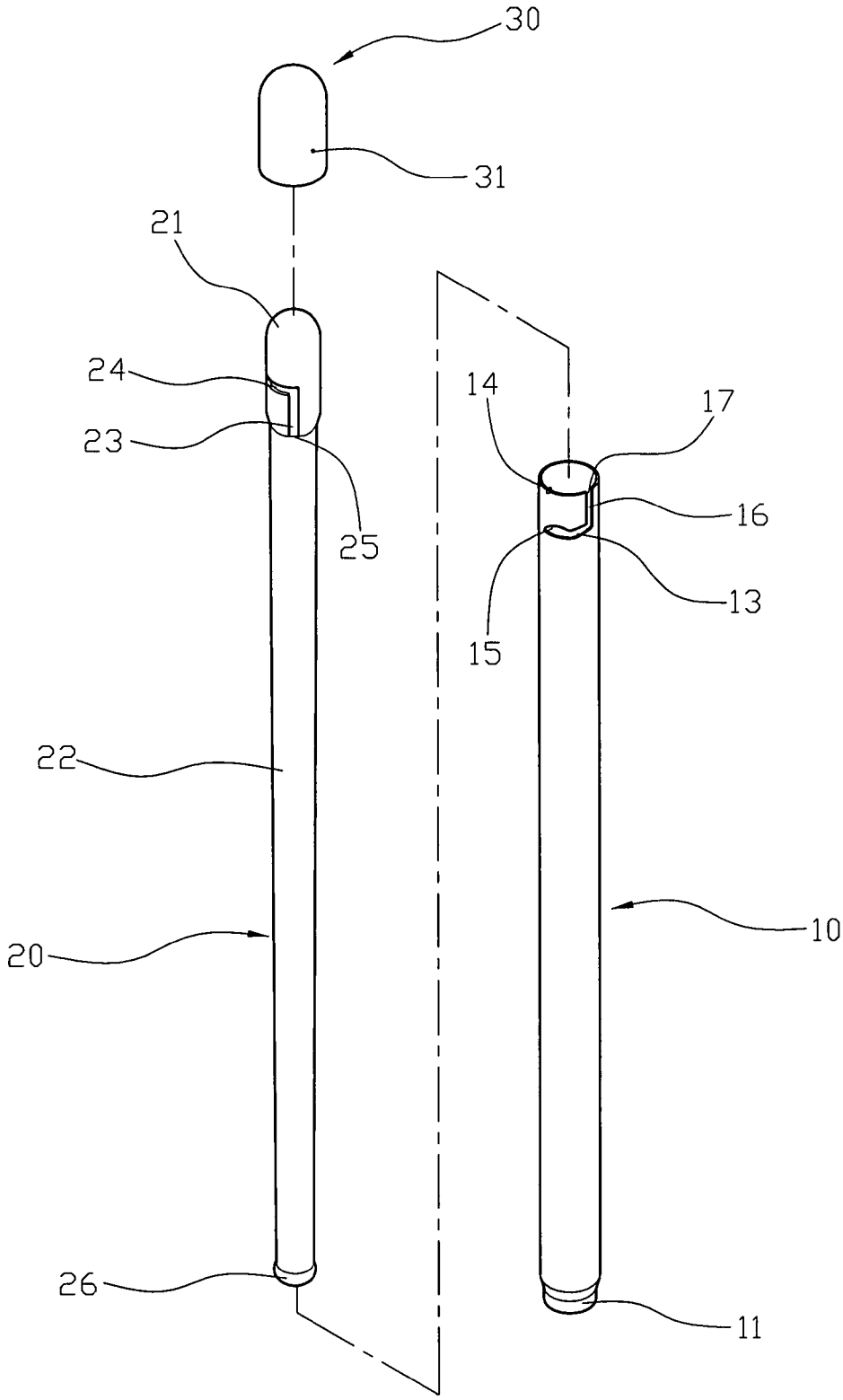
FIG. 10 is an exploded perspective view of a retractable chopstick in accordance with another preferred embodiment of the present invention.

As shown in FIG. 10, the locking groove 13 of the mounting sleeve 10 has a first end connected to the lower end of the guide groove 16 and a second end having a top formed with a substantially arc-shaped recessed stop portion 15 to stop movement of the locking boss 31 of the top cap 30. Thus, when the head 21 of the shank 20 is movable upward in the mounting sleeve 10 to press the top cap 30, the locking boss 31 of the top cap 30 is inserted into and detachably locked in the stop portion 15 of the locking groove 13 so that the top cap 30 is locked onto the mounting sleeve 10 to prevent the top cap 30 from being driven by the shank 20 to rotate relative to the mounting sleeve 10 and to prevent the top cap 30 from being detached from the mounting sleeve 10.

Accordingly, the shank 20 can be retracted into the mounting sleeve 10 when not in use, so that whole volume of the retractable chopstick is reduced largely, thereby facilitating the user carrying, packaging and storing the retractable chopstick. In addition, the retractable chopstick can be reused successively, thereby saving the natural resource and thereby providing a sanitary effect. Further, the user only needs to rotate the shank 20 relative to the mounting sleeve 10 to expand the shank 20 outwardly from the mounting sleeve 10 or to retract the shank 20 into the mounting sleeve 10, thereby facilitating the user operating the retractable chopstick.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A retractable chopstick, comprising:

a hollow mounting sleeve;

a shank retractably mounted in the mounting sleeve and movable relative to the mounting sleeve between a retracted position where an upper end of the shank is locked in an upper end of the mounting sleeve and a lower end of the shank is received in a lower end of the mounting sleeve and an expanded position where the shank protrudes outwardly from the mounting sleeve and the upper end of the shank is locked in the lower end of the mounting sleeve; wherein:

the lower end of the mounting sleeve is formed with a radially and inwardly extending lower positioning boss;

the upper end of the shank is provided with an enlarged head which has a periphery formed with an axially extending guide groove to guide movement of the lower positioning boss of the mounting sleeve and a transversely extending locking groove connected to the guide groove to lock the lower positioning boss of the mounting sleeve.

2. The retractable chopstick in accordance with claim 1, wherein:

the guide groove of the head has an upper end connected to the locking groove and a lower end formed with an opening located at a connection of the head and the upper end of the shank;

the lower positioning boss of the mounting sleeve is inserted through the opening into the guide groove of the head and detachably locked in the locking groove of the head when the shank is disposed at the expanded position so that the head of the shank is locked in the lower end of the mounting sleeve.

3. The retractable chopstick in accordance with claim 2, wherein the lower positioning boss of the mounting sleeve is inserted into and detachably locked in the locking groove of the head by rotation of the shank relative to the mounting sleeve.

4. The retractable chopstick in accordance with claim 1, wherein the locking groove of the head is perpendicular to the guide groove so that the guide groove and the locking groove of the head form a substantially inverted L-shaped profile.

5. The retractable chopstick in accordance with claim 1, wherein the lower end of the shank is provided with a radially and outwardly extending annular holding portion which protrudes outwardly from the lower end of the mounting sleeve.

6. The retractable chopstick in accordance with claim 1, wherein the lower end of the mounting sleeve has an end portion formed with a tapered and stepped enclosure located under the lower positioning boss and having a diameter smaller than that of the head of the shank.

7. The retractable chopstick in accordance with claim 6, wherein the head of the shank is retained by the enclosure of the mounting sleeve when the shank is disposed at the expanded position.

8. The retractable chopstick in accordance with claim 1, wherein the upper end of the mounting sleeve is formed with a radially and inwardly extending upper positioning boss that presses the periphery of the head when the shank is disposed at the retracted position so that the head of the shank is locked in the upper end of the mounting sleeve.

9. The retractable chopstick in accordance with claim 1, further comprising a top cap mounted on the upper end of the mounting sleeve to prevent the upper end of the shank from being detachable from the upper end of the mounting sleeve when the shank is disposed at the retracted position.

10. The retractable chopstick in accordance with claim 9, wherein the top cap is removably mounted on the upper end of the mounting sleeve to stop the head of the shank.

11. The retractable chopstick in accordance with claim 9, wherein:

the top cap is formed with a radially and inwardly extending lower locking boss;

the upper end of the mounting sleeve has a periphery formed with an axially extending guide groove to guide movement of the locking boss of the top cap and a transversely extending locking groove connected to the guide groove to lock the locking boss of the top cap.

12. The retractable chopstick in accordance with claim 11, wherein:

the guide groove of the mounting sleeve has a lower end connected to the locking groove and an upper end formed with an opening;

the locking boss of the top cap is inserted through the opening into the guide groove of the mounting sleeve and detachably locked in the locking groove of the mounting sleeve so that the top cap is locked on the upper end of the mounting sleeve.

13. The retractable chopstick in accordance with claim 12, wherein the locking boss of the top cap is inserted into and detachably locked in the locking groove of the mounting sleeve by rotation of the top cap relative to the mounting sleeve.

14. The retractable chopstick in accordance with claim 12, wherein the locking groove of the mounting sleeve has a first end connected to the lower end of the guide groove and a second end having a top formed with a recessed stop portion to stop movement of the locking boss of the top cap.

15. The retractable chopstick in accordance with claim 14, wherein the stop portion of the locking groove is substantially arc-shaped.

16. The retractable chopstick in accordance with claim 14, wherein when the head of the shank is movable upward in the mounting sleeve to press the top cap, the locking boss of the top cap is inserted into and detachably locked in the stop portion of the locking groove so that the top cap is locked onto the mounting sleeve to prevent the top cap from being driven by the shank to rotate relative to the mounting sleeve and to prevent the top cap from being detached from the mounting sleeve.

17. The retractable chopstick in accordance with claim 11, wherein the locking groove of the mounting sleeve is perpendicular to the guide groove so that the guide groove and the locking groove of the mounting sleeve form a substantially inverted L-shaped profile.

18. The retractable chopstick in accordance with claim 1, wherein the shank is detachably inserted into the mounting sleeve from the upper end of the mounting sleeve.

19. The retractable chopstick in accordance with claim 1, wherein the head of the shank has a diameter smaller than that of the mounting sleeve.

* * * * *